US005887571A

United States Patent [19]

Yokota

[11] Patent Number: 5,887,571

[45] Date of Patent: Mar. 30, 1999

[54] FUEL INJECTION PUMP PLUNGER

[75] Inventor: Tohru Yokota, Saitama Perfecture, Japan

[73] Assignee: Zexel Corporation, Japan

[21] Appl. No.: 959,852

[22] Filed: Oct. 29, 1997

[30] Foreign Application Priority Data

Oct. 31, 1996 [JP] Japan ..... 8-304143

[51] Int. Cl.[6] ..... F02M 37/04

[52] U.S. Cl. ..... 123/501

[58] Field of Search ..... 123/500, 501, 123/502; 417/499, 494

[56] References Cited

U.S. PATENT DOCUMENTS

| | | | |
|---|---|---|---|
| 4,830,587 | 5/1989 | Guntert et al. | 123/500 |
| 5,217,356 | 6/1993 | Ryuhzaki | 123/500 |
| 5,219,280 | 6/1993 | Yashiro | 123/500 |
| 5,233,955 | 8/1993 | Kraemer et al. | 123/500 |
| 5,591,021 | 1/1997 | Guentert et al. | 417/494 |

FOREIGN PATENT DOCUMENTS

| | | |
|---|---|---|
| 63-503076 | 11/1988 | Japan . |
| 4-100063 | 8/1992 | Japan . |
| 5-087011 | 4/1993 | Japan . |

*Primary Examiner*—Thomas N. Moulis
*Attorney, Agent, or Firm*—Ostrolenk, Faber, Gerb & Soffen, LLP

[57] ABSTRACT

The present invention provides a fuel injection pump plunger whereby it is possible to avoid deformation of the timing sleeve 11 in the fact of increased fuel pressure, to ensure no-injection state even with elimination of the furrow, and to prevent secondary injection. It results from the realization that it is possible to replace the furrow with an aperture with which the spill port can connect in line with the movement of the plunger 20, and is wherein an aperture (horizontal aperture 21) is provided below and separate from said inclined lead 10, this aperture 21 being such that it is not only connected with said central fuel passage 8, but in the no-injection position of said control rack 13 allows said spill port 12 to engage either with this aperture 21, with said inclined lead 10, or with both of them, the area of the aperture when they engage being the same as the area of said central fuel passage 8.

5 Claims, 6 Drawing Sheets

FUEL INJECTION PUMP PLUNGER

BACKGROUND OF THE INVENTION

1. Field of the Invention

The present invention relates to a fuel injection pump plunger, and in particular to a fuel injection pump plunger wherein the structure has been improved by eliminating the furrow on the inclined lead.

2. Description of the Related Art

In fuel injection pumps fitted to diesel engines, and particularly in on-line fuel injection pumps, it has hitherto been normal practice to control the amount of fuel injected by creating on the outer periphery of the plunger an inclined lead formed from a spiral groove, and to create a spill port on a timing sleeve in a position which coincides with the position of this inclined lead.

Instances are provided by Japanese Patents S63[1988]-503076 and H5[1993]-87011, and by Japanese Utility Model H4[1992]-100063.

There follows an explanation with reference to FIGS. 5 and 6, in which the abovementioned Japanese Utility Model H4[1992]-100063 is taken as an example. FIG. 5 is a cross-sectional view of the principal part of a conventional fuel injection pump 1 at commencement of fuel injection, while FIG. 6 is a cross-sectional view of the principal part at conclusion of fuel injection. The fuel injection pump 1 has a delivery valve housing or pump housing 2 and a plunger barrel 3 located within this pump 2 housing. Inside is formed a fuel reservoir chamber 4.

Between this pump housing 2 and plunger barrel 3 is located a plunger 5 in such a manner that it is capable of rotation and reciprocating motion. Above the plunger 5 is formed a high-pressure fuel pressure chamber or plunger chamber 6, which connects with a delivery valve (not shown in the drawing).

The plunger 5 has a fuel suction and exhaust port 7, a central fuel passage 8 which connects with the fuel suction and exhaust port 7 and runs to the plunger chamber 6, a peripheral furrow 9 which connects with the fuel suction and exhaust port 7, and a peripheral inclined lead 10 which connects with this furrow 9.

A timing sleeve 11 (control sleeve) is fitted externally to the plunger 5. This timing sleeve 11 allows the pre-stroke (the stroke from the bottom dead point of the plunger 5 to commencement of injection) to be modified by permitting vertical motion with the aid of a control rod (not shown in the drawing) so as to alter the position relative to the plunger 5.

A spill port 12 is formed in the timing sleeve 11 in the direction of its radius. This spill port 12 is formed in a position which coincides with that of the inclined lead 10 in the direction of the axis of the plunger 5.

A control rack 13 is provided to allow the plunger 5 to rotate around its axis in relation to the timing sleeve 11, and it is possible for the spill port 12 and the inclined lead 10 to coincide in the direction of the axis of the plunger 5 even if the plunger 5 rotates as a result of the operation of the control rack 13.

In a fuel injection pump 1 of this structure, the lowering of the plunger 5 causes the fuel within the fuel reservoir chamber 4 to be admitted through the fuel suction and exhaust port 7, while its raising causes the fuel suction and exhaust port 7 to close by the action of the lower edge 11A of the timing sleeve 11, thus commencing compression of the fuel (FIG. 5).

When the plunger 5 rises further until the inclined lead 10 coincides with the spill port 12, the plunger chamber 6 and the fuel reservoir chamber 4 connect via the central fuel passage 8, fuel suction and exhaust port 7, furrow 9 and inclined lead 10, with the result that a prescribed amount of fuel spills from the spill port 12 into the fuel reservoir chamber 4, thus concluding fuel injection (FIG. 6). The plunger 5 continues to rise, the furrow 9 protrudes beyond the upper edge 11B of the timing sleeve 11, and as a result fuel spills from this furrow 9 also.

Control of the amount of fuel injected is achieved by operating the control rack 13 to allow the plunger 5 to rotate about its axis and alter the position at which the inclined lead 10 and spill port 12 engage, thus adjusting the effective stroke S of the fuel delivery (FIG. 5).

It is also possible to advance or retard the timing of the fuel injection by operating the timing sleeve 11 up and down in order to adjust the pre-stroke.

FIG. 7 is a side elevation of the principal part showing the relationship between the furrow 9 of the plunger 5 and the spill port 12 of the timing sleeve 11. The purpose of the furrow 9 is to ensure this no-injection state.

In other words, when the plunger 5 is rotated in relation to the timing sleeve 11 and positioned so that the spill port 12 can coincide with the furrow 9, if the plunger 5 is above a prescribed position, the plunger chamber 6 and the fuel reservoir chamber 4 are connected with each other via the central fuel passage 8, fuel suction and exhaust port 7, furrow 9 and spill port 12, and the plunger 5 is unable to implement the action of compressing the fuel. Thus a state of no-injection is achieved, wherein it is possible to halt the fuel delivery function of the fuel injection pump 1 in emergencies and as desired at other times when this is necessary.

Moreover, inasmuch as the area of the passage is greater than the prescribed value, the furrow 9 also has the function of avoiding secondary injection by ensuring that it does not act as a throttle to fuel passing through when fuel spills from the spill port 12.

However, there is a problem in that the timing sleeve 11 becomes deformed as a result of the fact that in order for it to achieve this function the groove 9 occupies a relatively large proportion of the outer periphery of the plunger 5.

In other words, FIG. 8 is an end cross-section of the plunger 5 and the timing sleeve 11. As the drawing shows, the timing sleeve 11 becomes deformed and assumes an elliptical shape (the imaginary line in the drawing) as a result of the pressure of the fuel acting from the central fuel passage 8 of the plunger 5 on the inclined lead 10 and especially on the furrow 9. This tendency is aggravated as the pressure of the fuel injection pump increases, leading to problems of locking between the plunger 5 and the timing sleeve 11, or causing damage to the timing sleeve 11.

With the foregoing in view, it is an object of the present invention to provide a fuel injection pump plunger wherein it is possible to prevent deformation of the timing sleeve in the face of high fuel pressure.

It is a further object of the present invention to provide a fuel injection pump plunger wherein it is possible to ensure no-injection state even with elimination of the furrow which is the chief cause of deformation of the timing sleeve.

It is yet a further object of the present invention to provide a fuel injection pump plunger wherein it is possible to ensure no-injection state by ensuring the area of the aperture of the spill port in no-injection state, and to avoid secondary injection.

SUMMARY OF THE INVENTION

In other words, the present invention focuses on the fact that the furrow may be replaced by an aperture which is capable of connecting with the spill port in line with the movement of the plunger, and on the fact that a no-injection state may be achieved without influencing the normal fuel injection function if the portion where the inclined lead serves to control the spill port and the amount of fuel injected forms its upper edge, while this aperture is formed beneath the inclined lead. It is a fuel injection pump plunger having a plunger which admits and delivers fuel by executing a reciprocating motion within a high-pressure plunger chamber, a timing sleeve which is fitted externally to this plunger and has a spill port formed in it, and a control rack which allows the plunger to rotate around its axis in relation to this timing sleeve, and having formed in the plunger a central fuel passage connecting with the plunger chamber and an inclined lead, which is capable of engaging with the spill port, the amount of fuel injected being controlled by operating the control rack to adjust the position wherein this inclined lead and the spill port engage, wherein an aperture is provided below and separate from the inclined lead, this aperture being such that it is not only connected with the central fuel passage, but in the no-injection position of the control rack allows the spill port to engage either with this aperture, with the inclined lead, or with both of them, the area of the aperture when they engage being the same as the area of the central fuel passage.

The abovementioned aperture may be horizontal, inclined or otherwise branch-shaped, so to speak, and connect to the inclined lead. Provided that the area of the aperture is the same as that of the central fuel passage, it is also feasible to adopt a circular aperture or one of any other desired shape which is independent of the inclined lead.

Because in the fuel injection pump plunger to which the present invention pertains an aperture is formed beneath and separate from the inclined lead, it is possible to ensure that the spill port of the timing sleeve always connects with this aperture when the control rack is operated to the no-injection position with the plunger in the prescribed rotational position, and when the plunger has attained the prescribed height, thus maintaining the no-injection state.

Moreover, if this aperture is structured in such a manner as to engage with the spill port along with the inclined lead, there is no need to create one as with the conventional furrow by removing a large portion from the outer periphery of the plunger. This means that the degree of deformation of the timing sleeve resulting from increased fuel pressure is less than in the case of a furrow, making it possible to inhibit this deformation to within prescribed limits.

Furthermore, the fact that the area of the aperture when it engages with the spill port is the same as that of the central fuel passage of the plunger makes it possible correctly to avoid secondary injection without the aperture becoming a throttle at the time of fuel spill.

DESCRIPTION OF THE PREFERRED EMBODIMENTS

Figure 1:
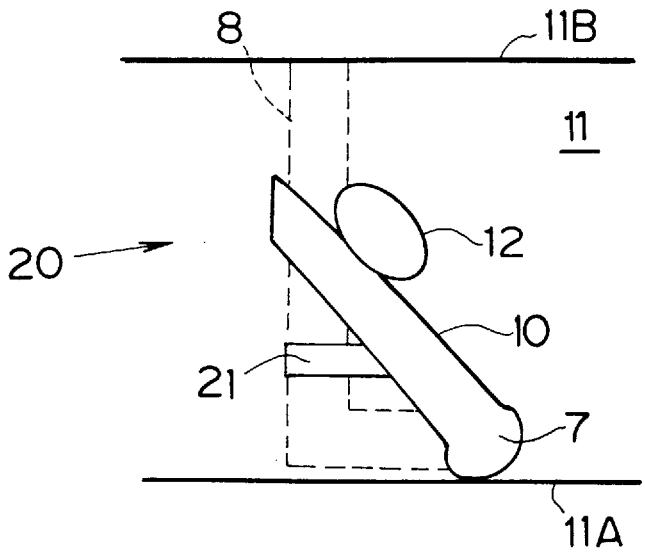
FIG. 1 is a side elevation of a fuel injection pump plunger 20 according to a first embodiment of the present invention in a state where the effective stroke is zero.
Figure 2:
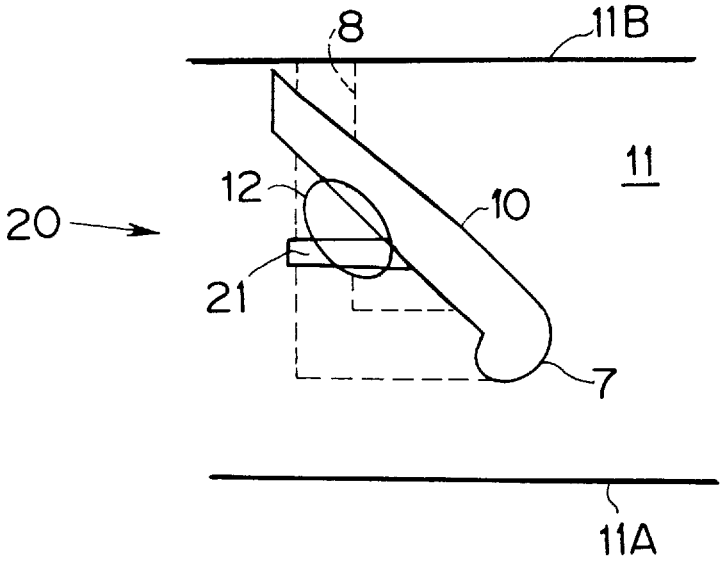
FIG. 2 is a side elevation of the same in the same state with the plunger 20 lifted.
Figure 3:
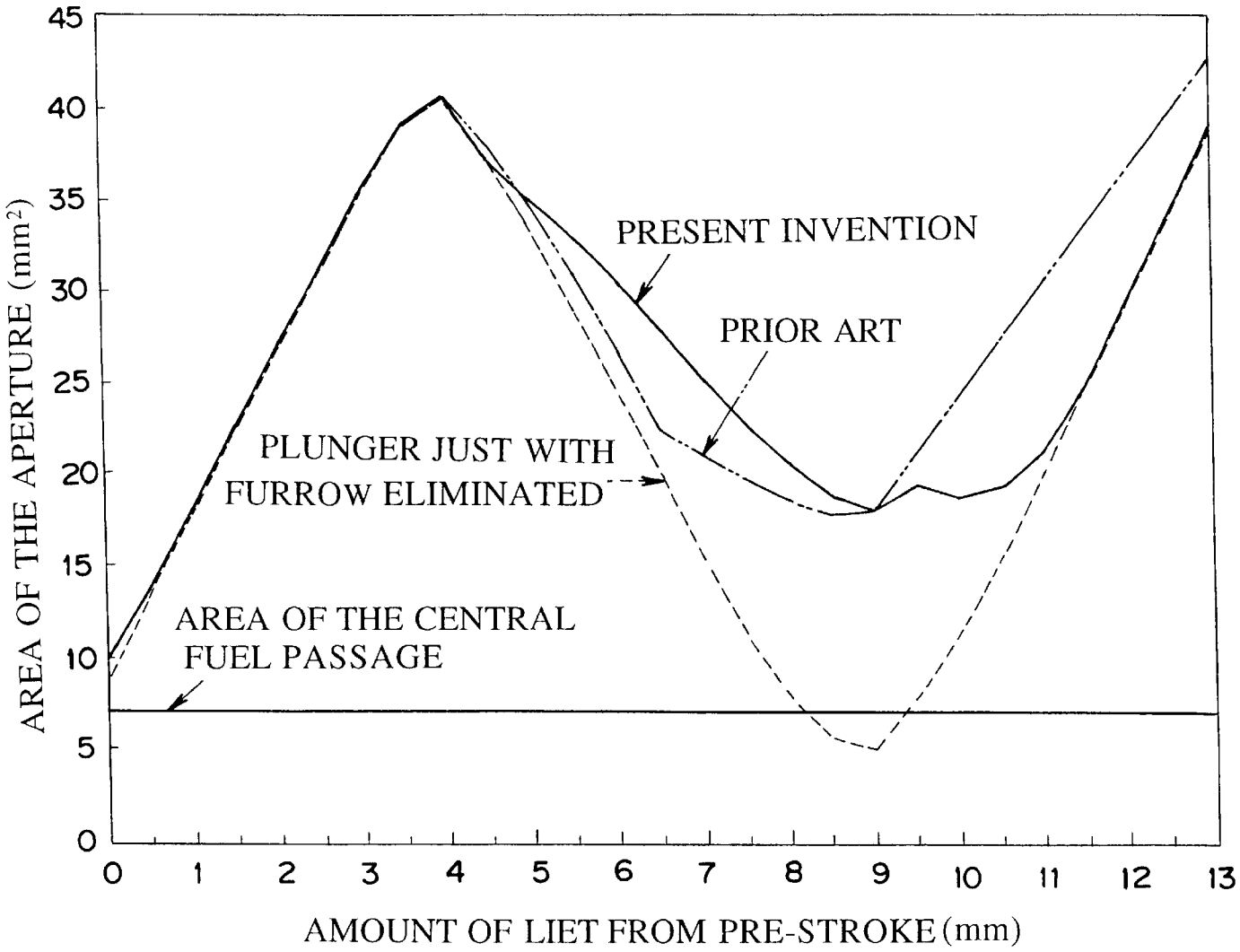
FIG. 3 is a graph showing the relationship of the area of the aperture of the plunger to the amount of lift from the plunger pre-stroke (amount of lift from commencement of fuel injection) when the control rack 13 is in the no-injection position.

There follows, with reference to FIGS. 1–3, a description of a fuel injection pump plunger 20 according to a first embodiment of the present invention. Parts which are the same as those shown in FIGS. 5–8 have been allocated the same codes, and details of them are omitted here.

FIG. 1 is a side elevation of a fuel injection pump plunger 20 according to a first embodiment of the present invention in a state where the effective stroke is zero, while FIG. 2 is a side elevation of it in the same state with the plunger 20 lifted. Unlike the plunger 5, no furrow 9 is formed on the outer periphery of the plunger 20. Instead, a horizontal aperture 21 is formed in such a manner as to be connected to the inclined lead 10.

In addition, a fuel suction and exhaust port 7 is formed at the very bottom of the inclined lead 10 in such a manner as to be connected to it.

The horizontal aperture 21 is beneath the inclined section of the inclined lead 10, and is formed in such a manner as not to engage with the lower edge 11A of the timing sleeve 11. Its shape, position and dimensions are such as will ensure that at least when the plunger 20 lifts in the no-injection position, it engages with the spill port 12 of the timing sleeve 11, thus allowing the plunger chamber 6 and the fuel reservoir chamber 4 to connect.

Moreover, the area of the aperture when this horizontal aperture 21 engages with the spill port 12 is determined so as to be the same as the area of the central fuel passage 8 of the plunger 20.

In other words, if the total area of the aperture when the horizontal aperture 21 and the inclined lead 10 together, or the horizontal aperture 21 alone, overlap with the spill port 12 is the same as the area of the central fuel passage 8 of the plunger 20, it is possible for the plunger chamber 6 to connect with the fuel reservoir chamber 4 without the risk of fuel being throttled from this overlay section when fuel injection terminates and fuel spills, thus making it possible to avoid secondary injection at the time of fuel spill.

By adopting a plunger 20 of this structure it is possible to prevent deformation of the timing sleeve 11 while at the same time retaining a function similar to that of the furrow 9 which is formed on the conventional plunger 5.

FIG. 3 is a graph showing the relationship of the area of the aperture of the plunger to the amount of lift from the plunger pre-stroke (amount of lift from commencement of fuel injection) when the control rack 13 is in the no-injection position. As will be seen from the graph, maximum area of the aperture is attained in a conventional plunger 5 with a furrow 9 when the spill port 12 coincides with both the inclined lead 10 and the furrow 9. The area of the aperture decreases somewhat as the plunger 5 rises, allowing the spill port 9 and the inclined head 10 to diverge from each other. It increases when the furrow 9 protrudes beyond the upper edge 11B of the timing sleeve 11.

On the other hand, simply eliminating the furrow 9 from the plunger means that the area of the aperture within a specified range of lift may be smaller than that of the central fuel passage 8, so that it is possible for the section where the spill port 12 and the inclined lead 10 engage to become a fuel throttle, risking secondary injection and other forms of decreased performance.

As may be seen from the graph, adopting the plunger 20 according to the present embodiment makes it possible to attain the same area of aperture as in the case of the conventional plunger 5 with furrow 9. Moreover, since the furrow 9 has been eliminated, deformation of the elliptical timing sleeve 11 can be kept to a minimum, while damage to this and the stick of the plunger 20 can be prevented, as can pressure loss resulting from fuel leakage from the plunger chamber 6 caused by deformation of the timing sleeve 11.

The shape, position and dimensions of the aperture which is formed beneath the inclined lead 10 may be determined at will.

Figure 4:
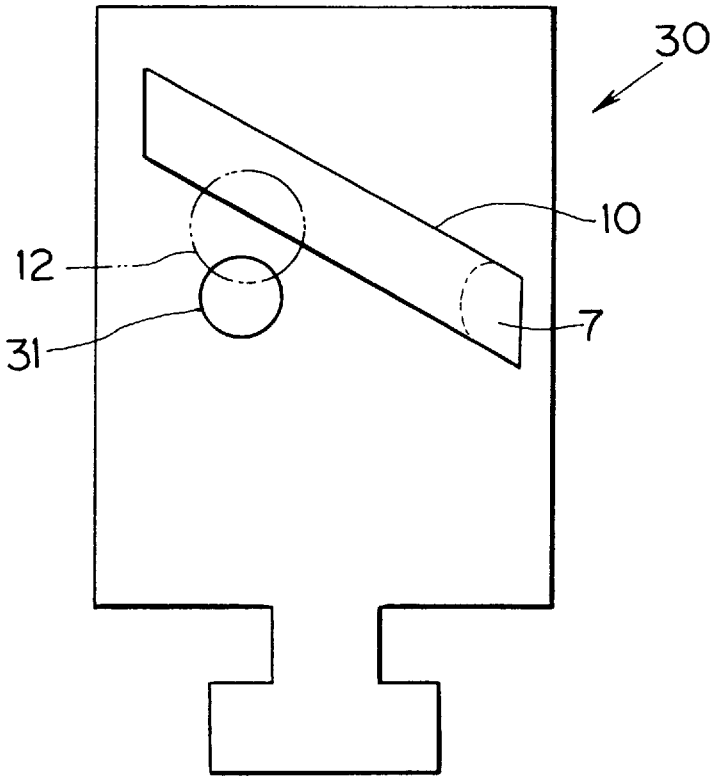
FIG. 4 is a side elevation of a fuel injection pump plunger 30 according to a second embodiment of the present invention.
Figure 5:
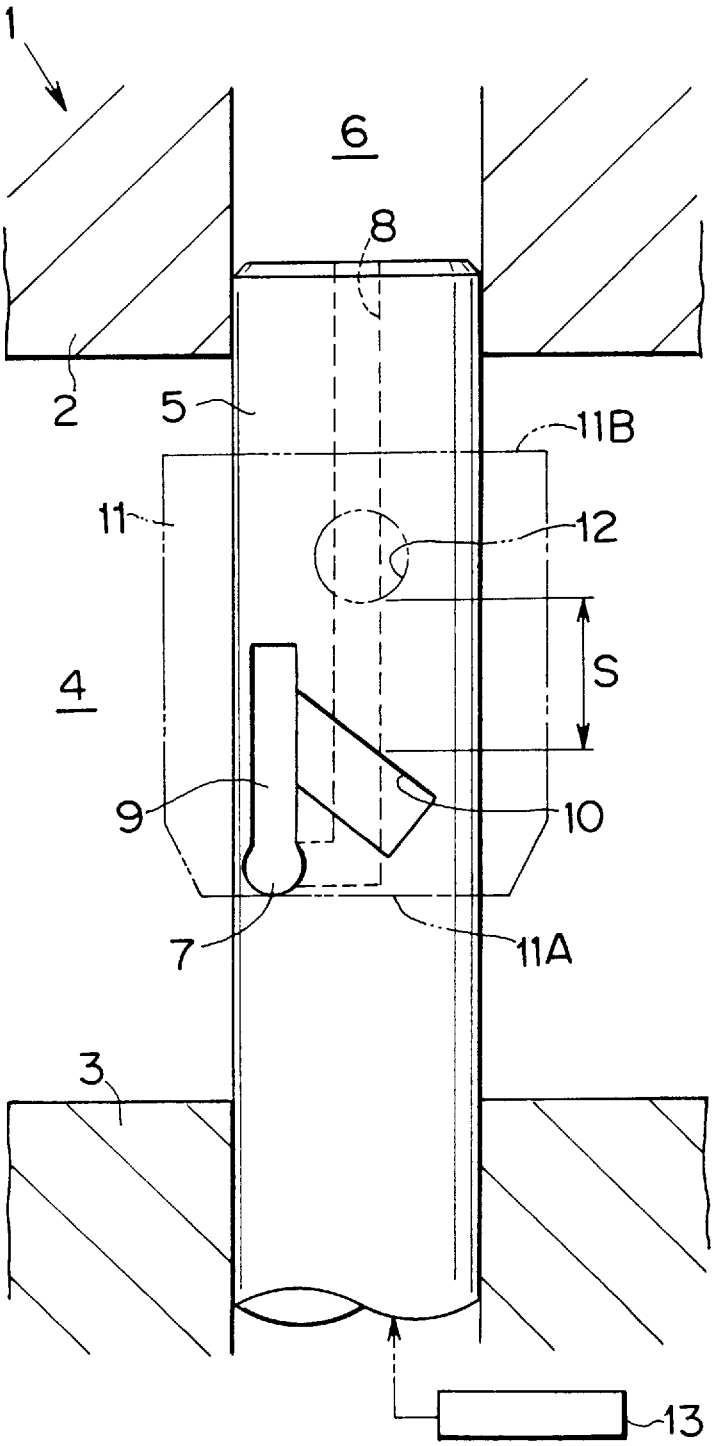
Fig. 5 Prior Art
FIG. 5 is a cross-sectional view of the principal part of a conventional fuel injection pump 1 at commencement of fuel injection.
Figure 6:
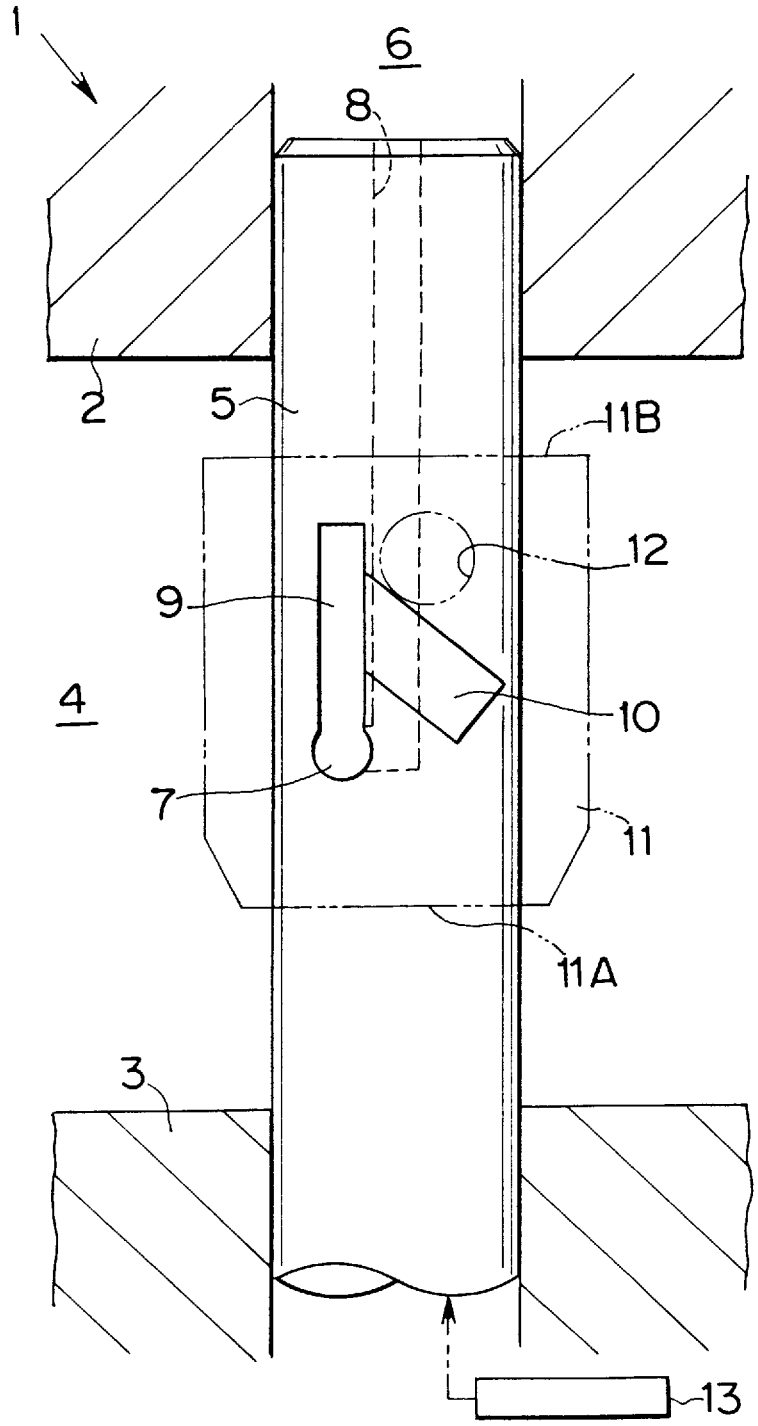
Fig. 6 Prior Art
FIG. 6 is a cross-sectional view of the principal part at conclusion of fuel injection.
Figure 7:
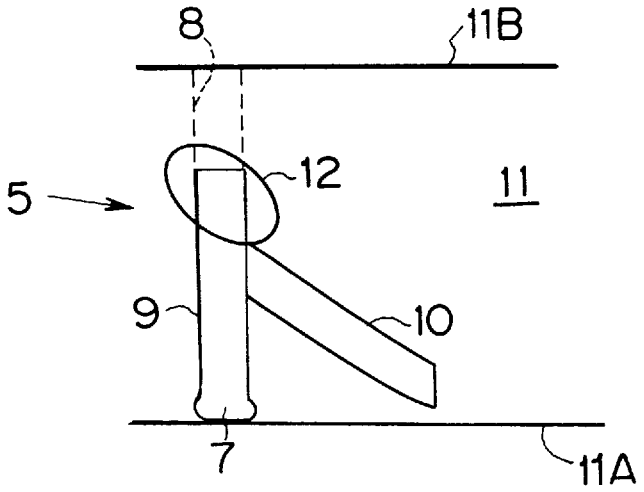
Fig. 7 Prior Art
FIG. 7 is a side elevation of the principal part showing the relationship between the furrow 9 of the plunger 5 and the spill port 12 of the timing sleeve 11.
Figure 8:
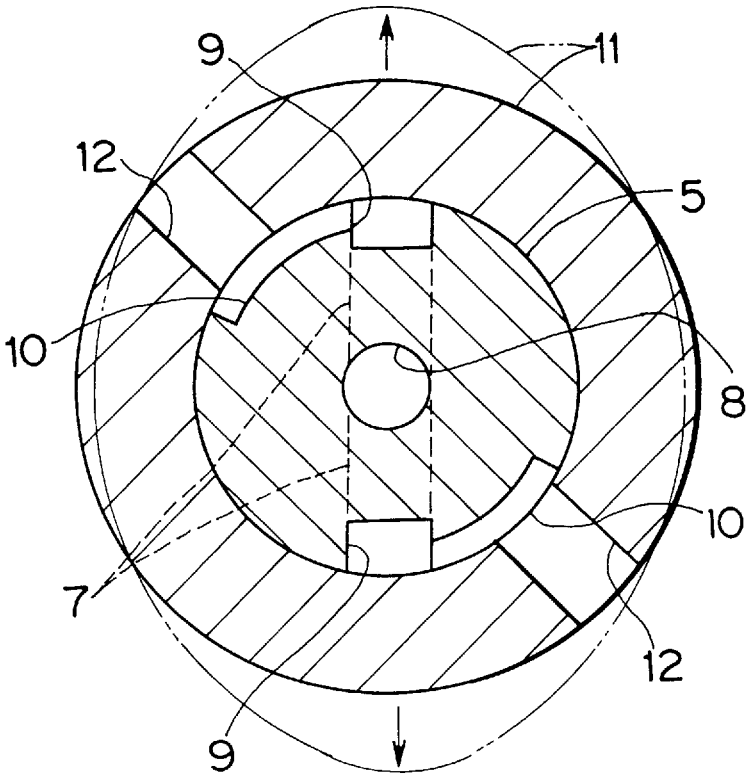
Fig. 8 Prior Art
FIG. 8 is an end cross-section of the plunger 5 and the timing sleeve 11.

For instance, FIG. 4 is a side elevation of a fuel injection pump plunger 30 according to a second embodiment of the present invention. In the case of the plunger 30, the horizontal aperture 21 is replaced by a circular aperture 31 formed independently of the inclined lead 10.

As with the horizontal aperture 21, the shape, position and dimensions of this circular aperture 31 are such as to ensure that when the plunger 30 lifts, it engages with the spill port 12 of the timing sleeve 11, thus allowing the plunger chamber 6 and the fuel reservoir chamber 4 to connect.

Moreover, as in the case of the horizontal aperture 21, the total area of the aperture when the circular aperture 31 alone or together with the inclined lead 10 engages with the spill port 12 is determined so as to be the same as the area of the central fuel passage 8 of the plunger 20.

By adopting a plunger 30 of this structure it is possible to prevent deformation of the timing sleeve 11 even with elimination of the furrow 9, as in the case of the plunger 20 (FIG. 1) with the horizontal aperture 21, while at the same time ensuring no-injection state.

As is clear from the above, inasmuch as an aperture is formed beneath the inclined lead instead of a furrow on the outer periphery of the plunger, the present invention makes it possible to prevent deformation of the timing sleeve, while at the same time ensuring no-injection state. This ensures sufficient spill area to prevent damage to the spill port and avoid secondary injection.

What is claimed is:

1. A fuel injection pump plunger having a plunger which admits and delivers fuel by executing a reciprocating motion within a high-pressure plunger chamber, a timing sleeve which is fitted externally to this plunger and has a spill port formed in it, and a control rack which allows said plunger to rotate around its axis in relation to this timing sleeve, and having formed in said plunger a central fuel passage connecting with said plunger chamber and an inclined lead, which is capable of engaging with said spill port, the amount of fuel injected being controlled by operating said control rack to adjust the position wherein this inclined lead and said spill port engage, in which an aperture is provided below and separate from said inclined lead, this aperture being such that it is not only connected with said central fuel passage, but in the no-injection position of said control rack allows said spill port to engage either with this aperture or said inclined lead, or with both of them, the area of the aperture when they engage being the same as the area of said central fuel passage.

2. The fuel injection pump plunger as described in claim 1, wherein said aperture is below the inclined lead, it being formed in such a manner as not to engage with the lower edge of said timing sleeve, but to engage with said spill port as the plunger lifts.

3. The fuel injection pump plunger as described in claim 1, wherein said aperture is horizontal and connects with said inclined lead.

4. The fuel injection pump plunger as described in claim 1, wherein said aperture is circular and is formed in a position where it is independent of said inclined lead.

5. The fuel injection pump plunger as described in claim 1, wherein it is positioned at the very bottom of said inclined lead, a fuel suction and exhaust port being formed which connects with said inclined lead and said central fuel passage.

* * * * *